US010920425B2

(12) United States Patent
Mercier et al.

(10) Patent No.: US 10,920,425 B2
(45) Date of Patent: Feb. 16, 2021

(54) SNOW REMOVAL APPARATUS

(71) Applicant: LES PRODUITS POLARMADE INC., Québec (CA)

(72) Inventors: Benoit Mercier, Québec (CA); Benoit Lavallée, Québec (CA)

(73) Assignee: LES PRODUITS POLARMADE INC., Quebec (CA)

( * ) Notice: Subject to any disclaimer, the term of this patent is extended or adjusted under 35 U.S.C. 154(b) by 316 days.

(21) Appl. No.: 15/995,961

(22) Filed: Jun. 1, 2018

(65) Prior Publication Data

US 2018/0347198 A1 Dec. 6, 2018

Related U.S. Application Data

(60) Provisional application No. 62/514,372, filed on Jun. 2, 2017.

(51) Int. Cl.
*E04D 13/10* (2006.01)

(52) U.S. Cl.
CPC ..... *E04D 13/106* (2013.01)

(58) Field of Classification Search
CPC ..... E04D 13/106; E04D 15/006; E04D 13/10; E01H 5/02; E01H 5/04; E01H 5/06; E01H 5/061; E01H 5/00
See application file for complete search history.

(56) References Cited

U.S. PATENT DOCUMENTS 3,998,486 A 12/1976 Mittelstadt
4,089,127 A 5/1978 Maijala
5,083,388 A 1/1992 Cooley
5,570,524 A 11/1996 Groat
5,791,707 A * 8/1998 Szakurski ..... A01B 1/225 294/51
5,943,796 A 8/1999 Hedstrom
5,971,653 A 10/1999 Harpell
(Continued)

FOREIGN PATENT DOCUMENTS

CN 203514662 4/2014
JP 09004160 1/1997

OTHER PUBLICATIONS

The Minnsnowta Roof Razor [online], RoofRake.com, 2017 [retrieved on Apr. 4, 2017], retreived from the Internet: <URL: http://www.roofrake.com/productpages/roofrazor.asp.>, 6 pages.
(Continued)

*Primary Examiner* — Jamie L McGowan
(74) *Attorney, Agent, or Firm* — Brooks Kushman P.C.

(57) ABSTRACT

A snow removal apparatus for cutting and removing snow from a sloped surface. The apparatus comprises a frame. The frame has a lower section and an upper section connected by side sections. The apparatus also comprises an elongated handle removably engageable to the frame and a slide connected to the lower section of the frame and extending away therefrom in a slide extending direction. The apparatus is selectively configurable in a push configuration where the handle is engaged to the lower section of the frame and extends in a direction substantially similar to the slide extending direction and a pull configuration where the handle is engaged to the upper section of the frame and extends in a direction substantially opposite to the slide extending direction.

19 Claims, 14 Drawing Sheets

(56) References Cited

U.S. PATENT DOCUMENTS

| | | | | |
|---|---|---|---|---|
| 6,092,315 | A | 7/2000 | Katauskas | |
| 6,158,791 | A | 12/2000 | Drew | |
| 6,189,942 | B1 | 2/2001 | Peterson et al. | |
| 6,202,329 | B1 * | 3/2001 | Supplee | E04D 13/106 294/54.5 |
| 6,578,890 | B1 * | 6/2003 | Gilmore | E04D 13/106 294/53.5 |
| 9,145,112 | B1 | 9/2015 | Ihde | |
| 9,828,775 | B2 * | 11/2017 | Senchuk | E04D 13/106 |
| 9,963,882 | B2 * | 5/2018 | Daneau | E01H 5/02 |
| 2004/0055184 | A1 | 3/2004 | Peterson et al. | |
| 2017/0089073 | A1 | 3/2017 | Daneau | |

OTHER PUBLICATIONS

Avalanche Roof Snow Removal System, Avalanche 1000 Premieum Package [online], Avalanche! Products by Rhino Manufacturing, 2014 [retrieved on Apr. 4, 2017], retrieved from the Internet: <URL: htte://www.avalanche-snow.ca/premium-roof-snow-removal-package.html>, 2 pages.

Roof Snow Removal [online], The Window Cleaning Store, 2017 [retrieved on Apr. 4, 2017], retreived from the Internet <URL: https//www.thewindowcleaningstore.com/collections/snow-removal>, 1 page.

* cited by examiner

SNOW REMOVAL APPARATUS

CROSS-REFERENCE TO RELATED APPLICATIONS

This application benefit of U.S. provisional application Ser. No. 62/514,372 filed on Jun. 2, 2017, the disclosure of which is hereby incorporated in its entirety by reference herein.

TECHNICAL FIELD

The present invention relates to the field of snow removal apparatuses. More specifically, it relates to an apparatus for removing snow from a sloped surface such as, for example, a roof of a building.

BACKGROUND

Removing snow from a roof of a building such as, a house, a cottage, a shed or the like can be a tedious and dangerous task. Hence, over the years, several apparatuses have been developed to help perform this task.

Indeed, apparatuses having several different configurations are known in the art. Among these, snow removal apparatuses of the cut and slide type, which are designed to allow users to easily remove snow from a sloped surface such as, for example and without being limitative, the roof of a building, using gravity force, are known in the art. Such apparatuses commonly allow a user to remove snow from the roof of a building, with the user standing on the ground and pushing a section of the apparatus through the accumulated snow on the roof of the building.

Known apparatuses of the cut and slide type however tend to suffer from several drawbacks. For example and without being limitative, known apparatuses of the cut and slide type tend to have a design which can lead to low durability, for example when used to remove hard packed or icy snow (i.e. the apparatuses tend to have a low life expectancy and/or tend to stop working accurately prematurely). Moreover, known apparatuses are commonly designed to be used in a single configuration, thereby resulting in a substantially low versatility of the apparatus. In other words, known apparatuses do not offer different operative configurations, specifically adapted to allow the user to operate the apparatus in different configurations depending, for example and without being limitative, on the snow condition, the configuration of the sloped surface or the like.

In view of the above, there is a need for an improved snow removal apparatus for cutting and removing snow from a sloped surface which, by virtue of its design and components, would be able to overcome or at least minimize some of the above-discussed prior art concerns.

SUMMARY

In accordance with a first general aspect, there is provided a snow removal apparatus for cutting and removing snow from a sloped surface. The apparatus comprises: a frame having a lower section and an upper section spaced apart from one another, the lower section and the upper section being connected by side sections; an elongated handle removably engageable to the frame; and a slide having a proximal end operatively connected to the lower section of the frame and a distal end, the slide extending away from the frame in a slide extending direction. The apparatus is selectively configurable in a push configuration, where the handle is engaged to the lower section of the frame and extends in a direction substantially similar to the slide extending direction and a pull configuration, where the handle is engaged to the upper section of the frame and extends in a direction substantially opposite to the slide extending direction.

In an embodiment, the apparatus further comprises a connector connecting the elongated handle to the frame. The connector extends along a longitudinal axis thereof and includes a frame-engaging section having a substantially flat section superposable to the corresponding one of the upper section and the lower section of the frame and securable thereto.

In an embodiment, each one of the lower section and the upper section of the frame comprises handle securement apertures defined therein. The handle securement apertures are configured to receive fasteners to selectively secure the connector to the corresponding one of the lower section and the upper section of the frame.

In an embodiment, the substantially flat section is angled relative to the longitudinal axis of the connector.

In an embodiment, the substantially flat section is angled of between about 7° and about 14° relative to the longitudinal axis of the connector.

In an embodiment, the elongated handle includes an angled section having a first substantially straight section and a second substantially straight section extending at an angle relative to one another.

In an embodiment, the angled section defines an angle of between about 7° and about 14° between the first substantially straight section and the second substantially straight section.

In an embodiment, the snow removal apparatus further comprises a slide connecting member having a first end and a second end. The first end of the slide connecting member is connectable to the slide, at the distal end thereof, and the second end of the slide connecting member is connectable to a section of the elongated handle, when the apparatus is configured in the push configuration.

In an embodiment, the frame has a snow engaging edge facing in a direction opposite to the slide extending direction, the snow engaging edge having a tapered configuration to define a tapered cutting edge.

In an embodiment, the snow removal apparatus further comprises extension members projecting downwardly from the lower section of the frame, at opposed ends thereof.

In accordance with another general aspect, there is provided a snow removal apparatus for cutting and removing strips of snow from a sloped surface. The apparatus comprises a snow removal assembly including a frame having a lower section and an upper section, the lower section and the upper section of the frame being substantially parallel to one another, with the upper section extending above the lower section; a slide operatively engaged to the lower section of the frame and extending away therefrom; and an elongated handle selectively securable to one of the lower section and the upper section of the frame. The handle is secured to the lower section of the frame to configure the apparatus in a push configuration and is secured to the upper section of the frame to configure the apparatus in a pull configuration.

In an embodiment, the slide extends in a slide extending direction and the elongated handle extends in a direction substantially similar to the slide extending direction when the apparatus is configured in the push configuration and in a direction substantially opposite to the slide extending direction when the apparatus is configured in the pull configuration.

In an embodiment, the apparatus further comprises a connector connecting the elongated handle to the frame. The connector extends along a longitudinal axis thereof and includes a frame-engaging section having a substantially flat section superposable to the corresponding one of the upper section and the lower section of the frame and securable thereto.

In an embodiment, each one of the lower section and the upper section of the frame comprises handle securement apertures defined therein. The handle securement apertures are configured to receive fasteners to selectively secure the handle connector to the corresponding one of the lower section and the upper section of the frame.

In an embodiment, the substantially flat section is angled relative to the longitudinal axis of the connector.

In an embodiment, the substantially flat section is angled of between about 7° and about 14° relative to the longitudinal axis of the connector.

In an embodiment, the elongated handle includes an angled section having a first substantially straight section and a second substantially straight section extending at an angle relative to one another.

In an embodiment, the angled section defines an angle of between about 7° and about 14° between the first substantially straight section and the second substantially straight section.

In an embodiment, the slide has a distal end. The apparatus further comprises a slide connecting member having a first end and a second end. The first end of the slide connecting member is connectable to the slide, at the distal end thereof, and the second end of the slide connecting member is connectable to a section of the elongated handle, when the apparatus is configured in the push configuration.

In an embodiment, the frame has a snow engaging edge facing in a direction opposite to the slide extending direction, the snow engaging edge having a tapered configuration to define a tapered cutting edge.

In an embodiment, the snow removal apparatus further comprises extension members projecting downwardly from the lower section of the frame, at opposed ends thereof.

DETAILED DESCRIPTION

Figure 1:
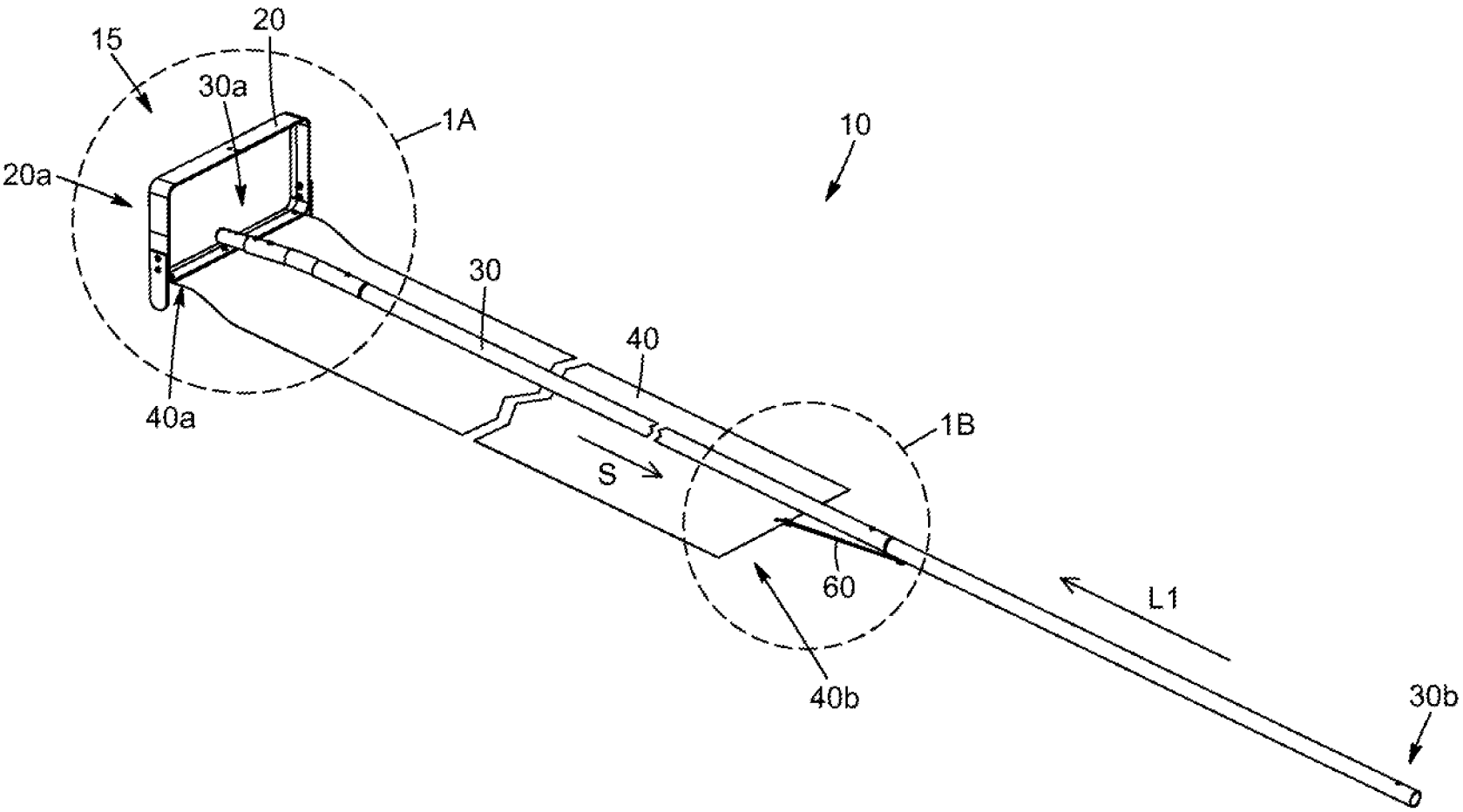
FIG. 1 is a perspective view of the snow removal apparatus, in accordance with an embodiment and shown in a push configuration where the handle is connected to a lower section of a frame of the apparatus.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

In the following description, the same numerical references refer to similar elements. The embodiments, geometrical configurations, materials mentioned and/or dimensions shown in the figures or described in the present description are embodiments only, given solely for exemplification purposes.

Moreover, although the embodiments of the snow removal apparatus and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the snow removal apparatus, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

In general terms, the following description relates to a snow removal apparatus for removing snow from sloped (or inclined) surfaces extending at a distance from the ground, such as, for example, roofs of buildings. The snow removal apparatus 10 described in more details below has a cut and slide configuration and is designed to cut strips (or chunks) of snow accumulated on the sloped surfaces, for subsequent sliding thereof towards the ground. The snow removal apparatus 10 uses a slide 40 connected to a rigid frame 20 (both of which will be described in more details below), to perform the cutting of the strips of snow and the succeeding sliding of the strips of snow towards the ground, by gravity.

Referring to FIGS. 1 to 4B, in accordance with an embodiment, there is shown the above-mentioned snow removal apparatus 10. The snow removal apparatus 10 includes a snow removal assembly (or snow cutting assembly), designated generally at 15. The snow removal assembly includes the rigid frame 20 configured to cut strips of snow from a snow-laden sloped surface (not shown). In the embodiment shown in FIGS. 1 to 4B, the snow removal assembly 15 also includes extension members 29 projecting downwardly from the rigid frame 20. The extension members 29 operate as motion facilitating members, designed to allow the rigid frame 20 of the apparatus 10 to move onto the sloped surface without substantially damaging the surface it is moved over (or at least minimizing the damage thereto). One skilled in the art will understand that, in alternative embodiments (which will be described in more details below), the snow removal assembly 15 could include motion facilitating members different than the extension members 29 of the embodiment shown in FIGS. 1 to 4B.

The apparatus also includes a handle 30 having a proximal end 30*a* and a distal end 30*b* and the slide 40 having a proximal end 40*a* and a distal end 40*b*. The handle 30 and the slide 40 are connected to the snow removal assembly 15 at their respective proximal end 30*a*, 40*a* and extend away therefrom. The slide 40 extends away from the snow removal assembly (i.e. extends away from the rigid frame 20 of the snow removal assembly 15), in a slide extending direction S. Each one of the handle 30 and the slide 40 will be described in more details below.

The rigid frame 20 is made of sturdy and rigid material such as, without being limitative, metal (e.g. aluminum, steel, etc.), hard plastic, carbon fiber or the like. In the embodiment shown, the rigid frame 20 of the snow removal assembly 15 has a substantially rectangular shape. As better shown in FIG. 1A, the rectangular-shaped rigid frame 20 includes a substantially horizontal lower section 24 and a substantially horizontal upper section 26, connected to one another by substantially vertical connecting sections 23 and 25. The substantially horizontal lower section 24, the substantially horizontal upper section 26 and the substantially vertical connecting sections 23, 25 together define a closed rectangular frame. The substantially horizontal lower section 24 and the substantially horizontal upper section 26 of the frame 20 are substantially parallel to one another, with the upper substantially horizontal section 26 extending above the substantially horizontal lower section 24. One skilled in the art will however understand that, in alternative embodiments (not shown), the frame 20 could have a different configuration, than the frame 20 of the embodiment shown. For example and without being limitative, in an embodiment, the frame 20 could have a different polygonal shape, such as, without being limitative a square shape, a trapezoid shape, an isosceles trapezoid shape, a parallelogram shape, or the like.

In the embodiment of FIGS. 1 to 4B, the extension members 29 are elongated plates mounted to the connecting sections 23, 25 of the frame 20 and having a substantially similar orientation than the connecting sections 23, 25 (i.e. being substantially parallel therewith to form extension thereof). The extension members 29 project downwardly past the substantially horizontal lower section 24. Hence, the extension members 29 project downwardly and substantially perpendicularly from the substantially horizontal lower section 24, at opposed ends thereof.

In an embodiment, the rigid frame 20 has at least one tapered cutting edge 22 for cutting snow, thus increasing the efficiency of the apparatus 10 in hard packed or icy snow. The tapered cutting edge 22 of the frame 20 corresponds to a snow engaging edge 20*a* of the frame 20. The snow engaging edge 20*a* of the frame 20 is the edge facing a direction opposite to the slide extending direction S (i.e., the tapered cutting edge 22 is the edge of the frame 20 located at a side of the frame 20 facing away from the slide 40). In other words, the tapered cutting edge 22 is the edge which is driven through the accumulated snow and cuts through the snow, when the apparatus 10 is used for removing snow from a snow-laden sloped surface. In the course of the present description, the term "tapered cutting edge" is used to refer to an edge having a tapered configuration (i.e. an edge gradually lessening in thickness to define a sharp fringe and operating as a blade for cutting through the snow).

In an embodiment, each one of the substantially horizontal lower section 24 and upper section 26 and the substantially vertical connecting sections 23, 25 include a tapered edge 22. One skilled in the art will however understand that, in alternative embodiments, only one or a subset of the substantially horizontal lower section 24 and upper section 26 and the substantially vertical connecting sections 23, 25 could include a tapered cutting edge 22. In another alternative embodiment, no tapered cutting edge 22 could be provided.

Still referring to FIGS. 1 to 4B, in the embodiment shown, a proximal end 40*a* of the slide 40 is mounted to the substantially horizontal lower section 24 of the frame 20 and extends away therefrom. The slide 40 extends from the frame 20 in the slide extending direction S, to provide the ability to slide strips of snow off the sloped surface, by gravity, after the snow is cut loose by the frame 20 moving therethrough. One skilled in the art will understand that, in alternative embodiments (not shown), the slide 40 could be operatively connected to the horizontal lower section 24 of the frame 20, without being directly mounted thereon. For example and without being limitative, the slide 40 could be mounted to an intermediate structure (not shown) which is in turn directly or indirectly connected to the horizontal lower section 24 of the frame 20.

The slide 40 is made of flexible slick material, such as, for example and without being limitative high-density polyethylene (HDPE), low-density polyethylene (LDPE), polyvinyl chloride (PVC), or the like, which allow easy adaptation to different sloped surfaces and good sliding of the snow thereon. In view of the above, the slide 40 thereby guides the strips of cut snow down the sloped surface and towards the ground. More precisely, in operation, the frame 20 of the snow removing assembly 15 is used to loosen light snow, or to cut off hardened snow, with the snow being subsequently removed from the sloped surface by gravity, through sliding on the slide 40 and off the sloped surface. Hence, the apparatus 10 thereby provides substantially easy and efficient snow removal from sloped surfaces extending at a distance from the ground, such as roofs of buildings.

In the embodiment shown in FIGS. 1 to 4B, as mentioned above, the handle 30 is connectable to the frame 20 at a proximal end 30*a* thereof. In an embodiment, the handle 30 is also made of sturdy and rigid material such as, without being limitative, metal (e.g. aluminum, steel, etc.), hard plastic, carbon fiber or the like. The handle 30 allows a user to seize (or grasp or hold) and maneuver the apparatus 10, to selectively direct the snow removal assembly 15 along a snow-laden sloped surface extending at a distance from the ground, for performing snow removal therefrom. The handle extends along a longitudinal axis L1, along a least a substantial part of the length thereof.

In the embodiment shown, the handle 30 includes an angled section 33 (or bent section) defining an angle relative to the longitudinal axis L1 of the handle 30, such that, in use, the snow engaging edge 20*a* of the frame 20 has a forward angle (i.e. a plane, along which the snow engaging edge 20*a* extends, is angled relative to the longitudinal axis L1 of the handle 30, with the section of the snow engaging edge 20*a* extending along the upper section 26 extending forwardly of the section of the snow engaging edge 20*a* of the of the lower section 24) and therefore engages the snow more aggressively. In other words, in an embodiment, the handle 30 includes an angled section 33 including a first substantially straight section 33*a* and a second substantially straight section 33*b*, extending at an angle relative to one another, with an additional substantially straight section 35*a* of the handle 33 being connected to one of the substantially straight sections 33*a*, 33*b* of the angled section 33 and forming an extension thereof. The additional substantially straight section 35*a* and the corresponding one of the substantially straight sections 33*a*, 33*b* of the angled section 33 connected thereto, extends substantially parallel to the longitudinal axis L1 handle handle 30.

In an embodiment, the angled section 33 defines an angle of between about 7° and about 14° between the first substantially straight section 33*a* and the second substantially straight section 33*b*. More precisely, in an alternative embodiment, the angled section defines an angle of between about 7° and about 10° between the first substantially straight section 33*a* and the second substantially straight section 33*b*. More precisely, in the embodiment shown, the angled section defines an angle of about 8° between the first substantially straight section 33*a* and the second substantially straight section 33*b*.

In an embodiment, the angled section 33 is positioned proximate to the frame 20, in order to provide a better effectiveness thereof. In an embodiment, the angled section 33 extends from the proximal end 30*a* of the handle and has a length ranging between about 12 inches and 24 inches (i.e. the combination of the first substantially straight section 33*a* and the second substantially straight section 33*b* ranges between about 12 inches and 24 inches). More precisely, in the embodiment shown, the angled section extends from the proximal end 30*a* of the handle and has a length of about 12 inches.

One skilled in the art will understand that, in an alternative embodiment (not shown), the handle 30 could be substantially straight (i.e. the handle 30 could be free of the above-described angled section 33 and therefore extend substantially parallel to the Longitudinal axis L1 thereof along its entire length).

Figure 2:
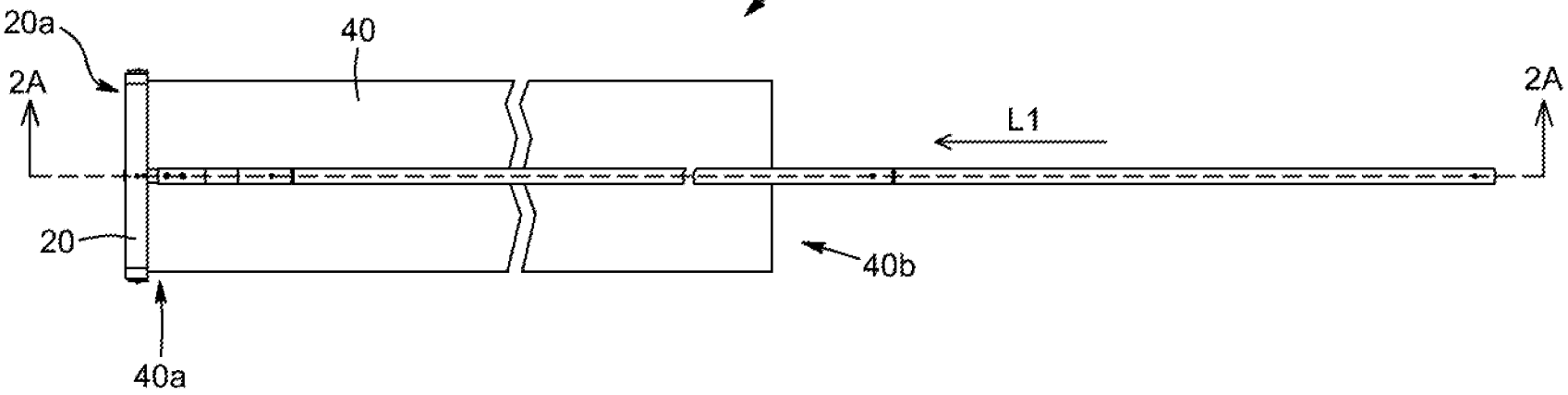
FIG. 2 is a top plan view of the snow removal apparatus of FIG. 1.
Figure 2A:
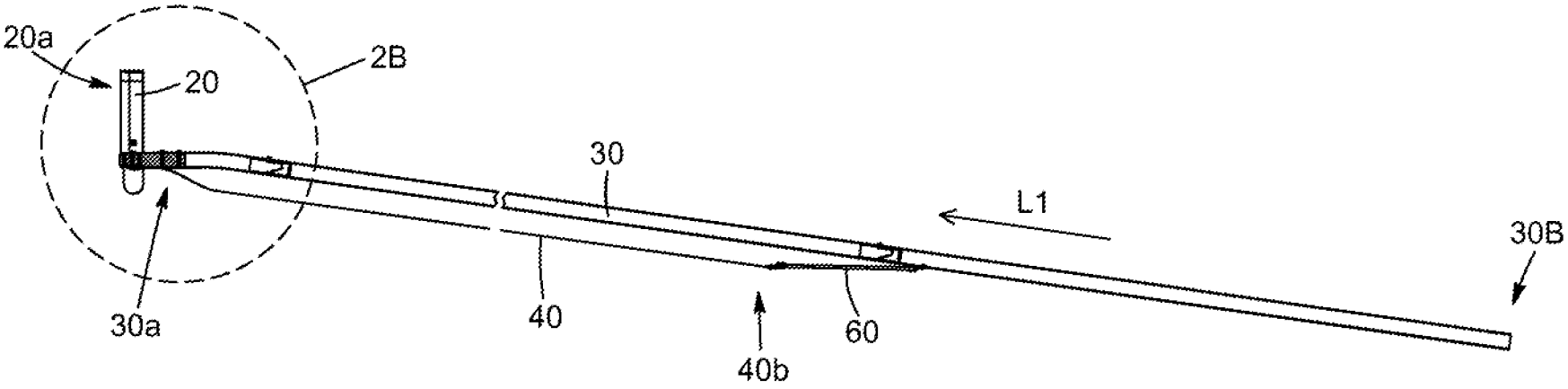
FIG. 2A is a cross-sectional view of the snow removal apparatus of FIG. 2, taken along Line 2A-2A in FIG. 2.
Figure 2B:
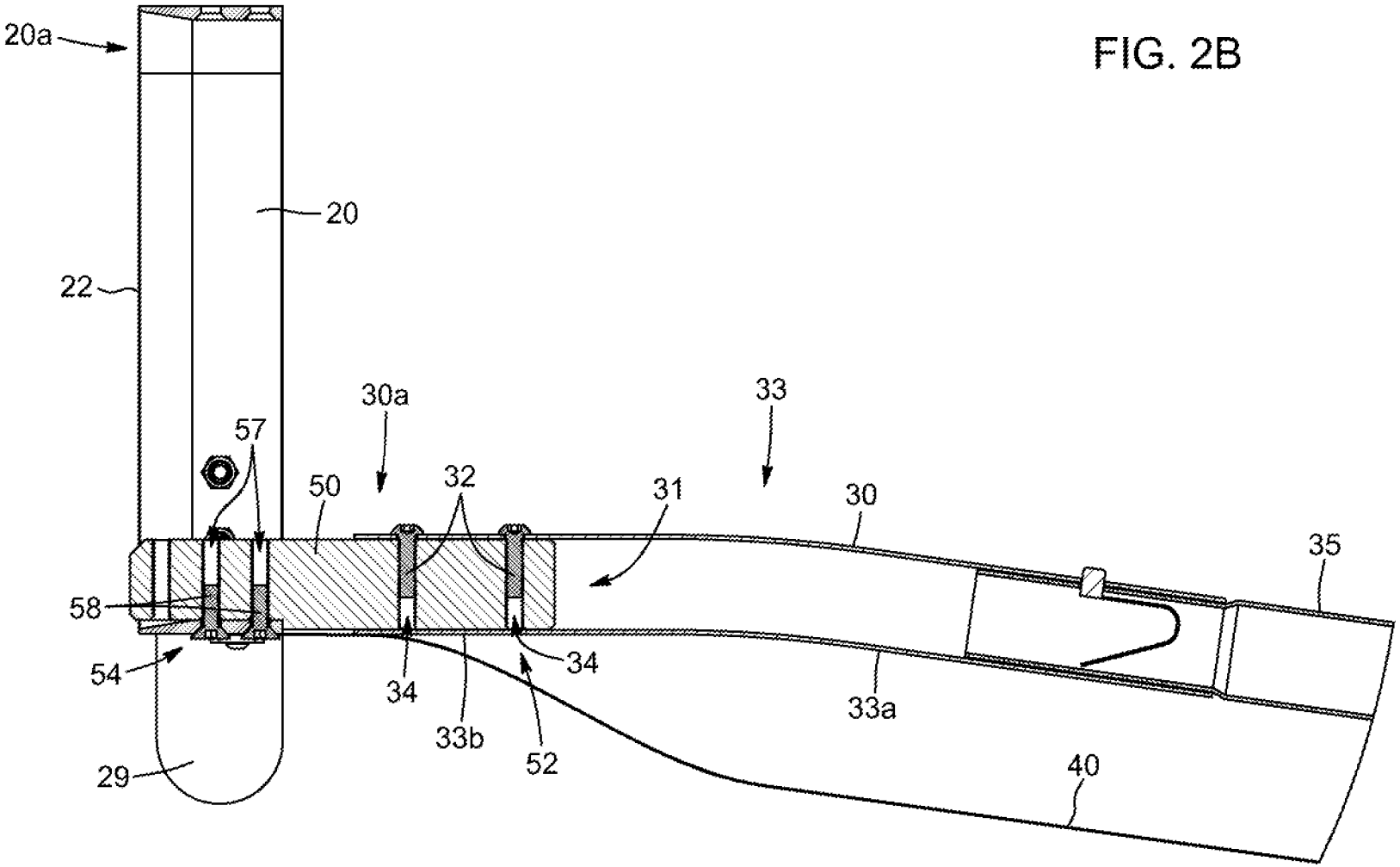
FIG. 2B is an enlarged view of section 2B of the snow removal apparatus of FIG. 2A.
Figure 3:
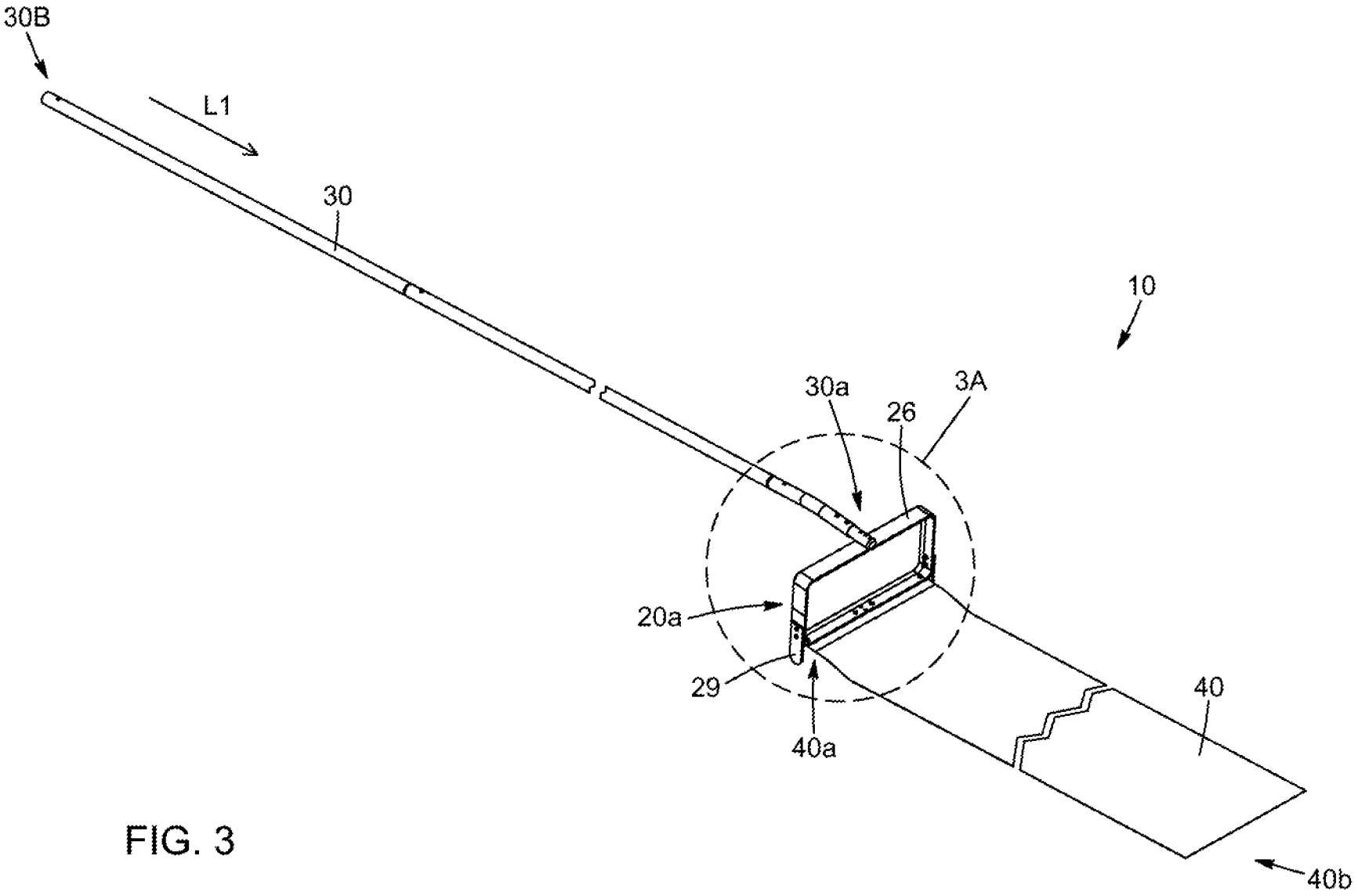
FIG. 3 is a perspective view of the snow removal apparatus of FIG. 1, shown in a pull configuration, where the handle is connected to an upper section of the frame.
Figure 4:
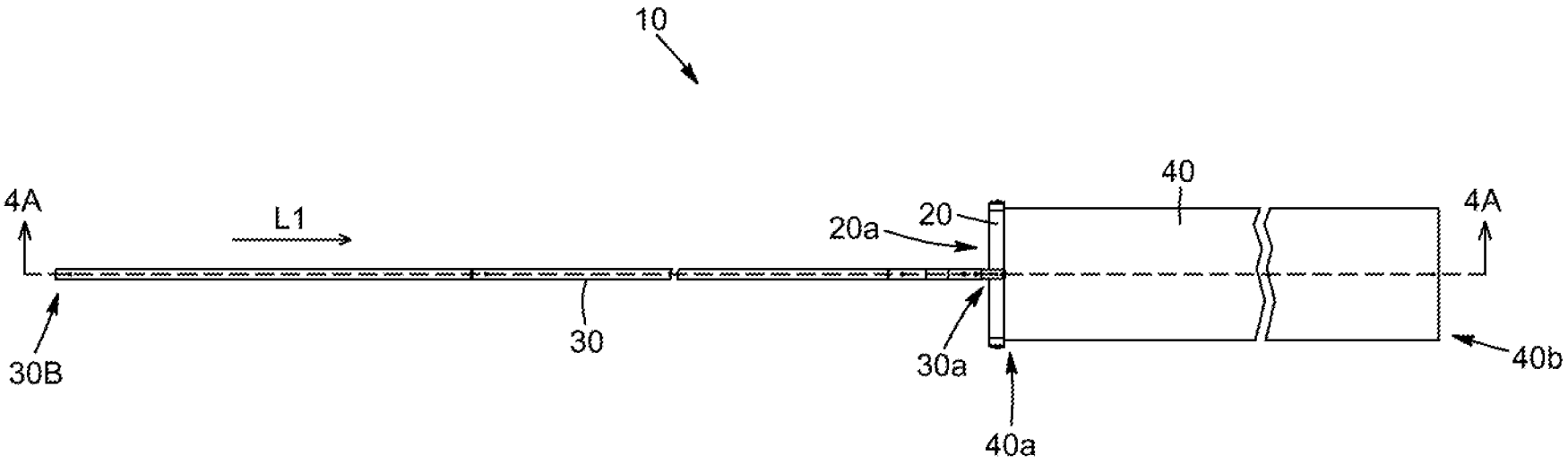
FIG. 4 is a top plan view of the snow removal apparatus of FIG. 3.
Figure 4A:
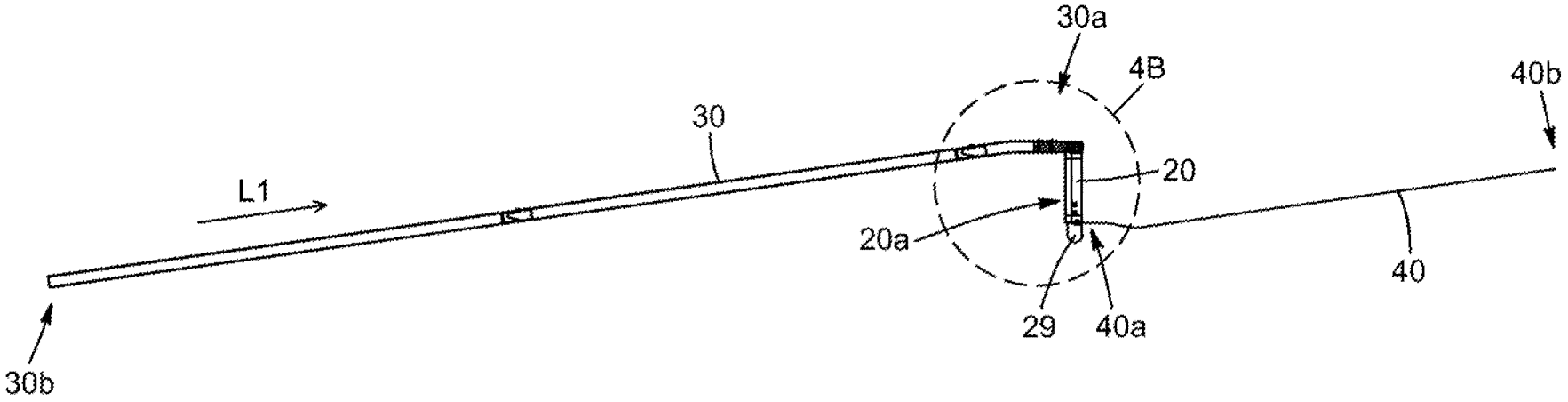
FIG. 4A is a cross-sectional view of the snow removal apparatus of FIG. 4, taken along Line 4A-4A in FIG. 4.
Figure 4B:
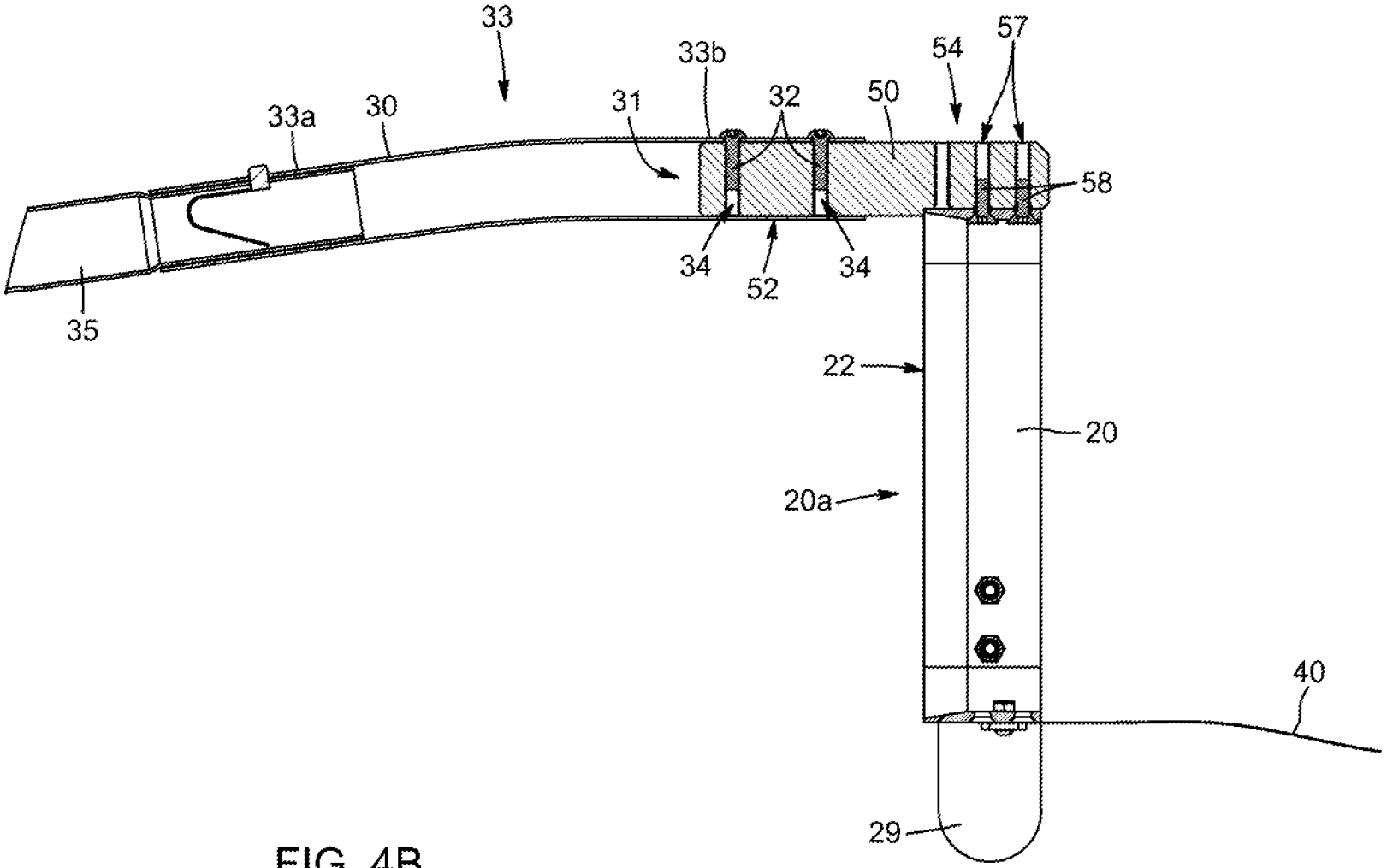
FIG. 4B is an enlarged view of section 4B of the snow removal apparatus of FIG. 4A.
Figure 5:
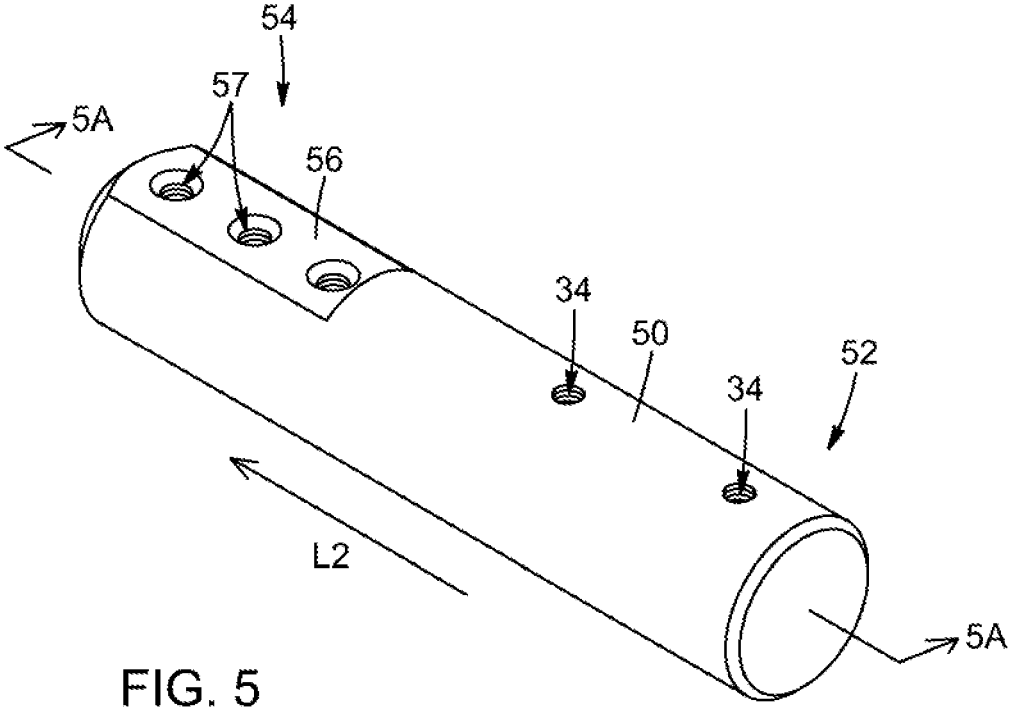
FIG. 5 is a perspective view of a connector of the snow removal apparatus of FIG. 1.
Figure 5A:
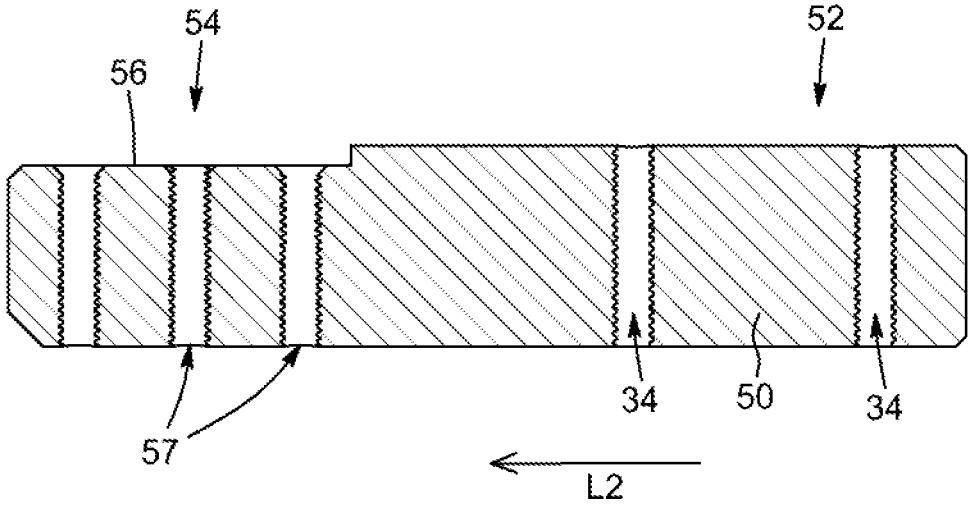
FIG. 5A is a cross sectional view of the connector of FIG. 5, taken along Line 5A-5A in FIG. 5.

Still referring to FIGS. 1 to 4B, the apparatus 10 can be selectively configured in a push configuration (see FIGS. 1 to 2B) and a pull configuration (see FIGS. 3 to 4B). In the push configuration (FIGS. 1 to 2B), the handle 30 is connected to the lower section 24 of the frame 20 and extends in a direction similar to the slide extending direction S (i.e. substantially in the direction in which the slide 40 extends from the frame 20). For example, in the push configuration, the apparatus 10 can be used to remove snow, with the user standing on the ground and pushing the apparatus 10 through the snow accumulated on a roof of a building. Connection of the handle 30 to the lower section 24 of the frame 20, when configured in the push configuration, is advantageous as it minimizes the strain on the frame 20, when the frame 20 is driven through accumulated show, therefore contributing to high durability of the apparatus 10.

Figure 1A:
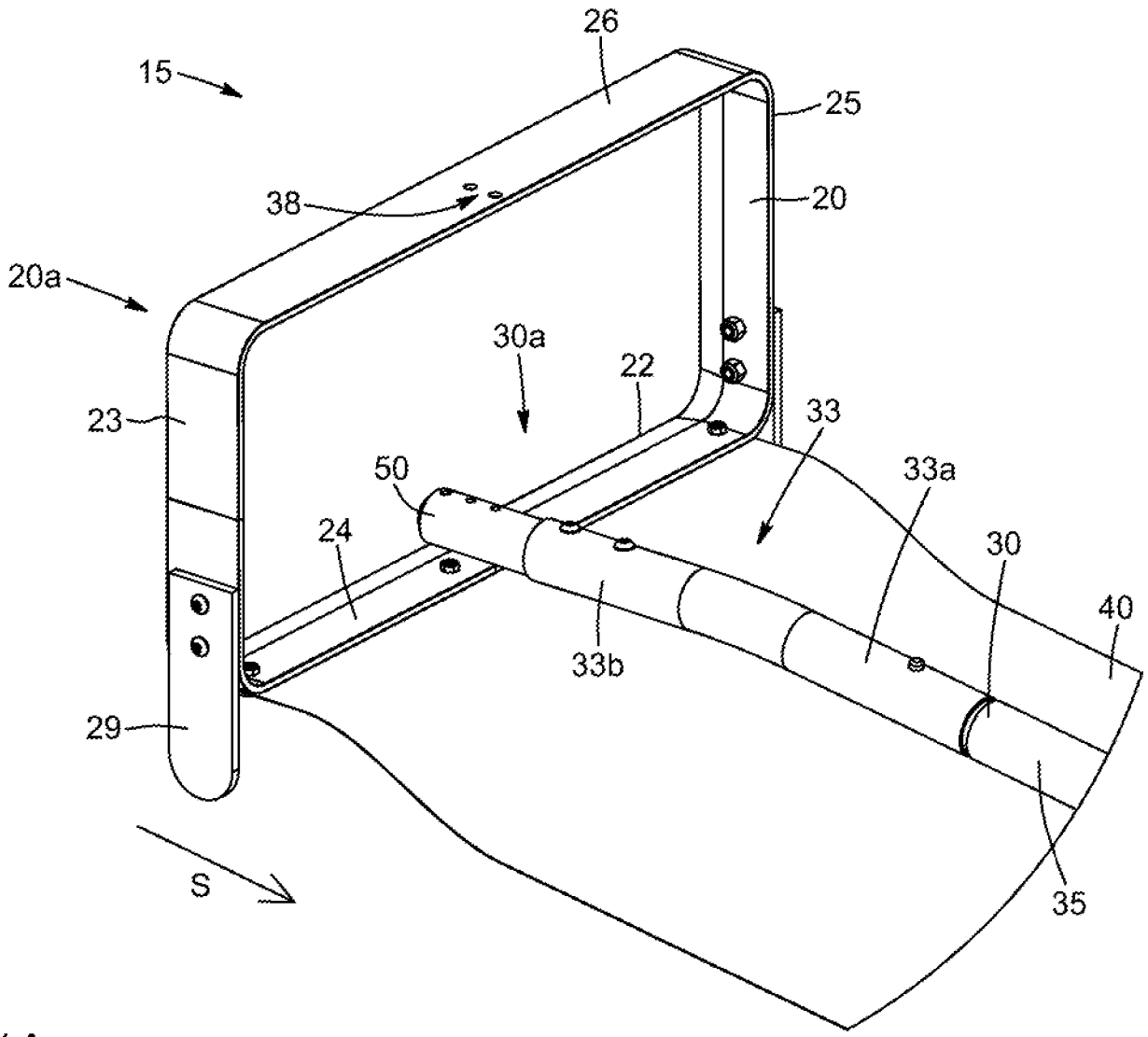
FIG. 1A is an enlarged view of section 1A of the snow removal apparatus of FIG. 1.
Figure 1B:
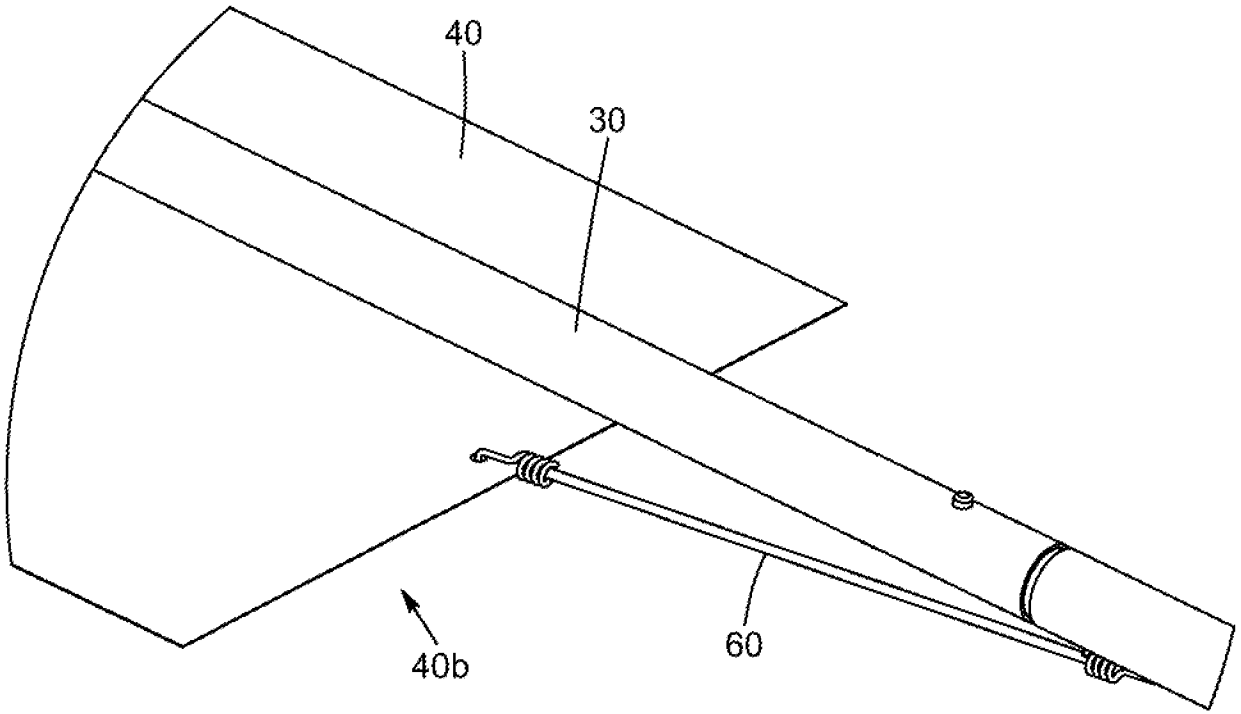
FIG. 1B is an enlarged view of section 1B of the snow removal apparatus of FIG. 1.

In an embodiment, in the push configuration, the distal end 40*b* of the slide 40 is connected to the handle 30 by a slide connecting member 60 (see FIGS. 1 and 1B). In an embodiment, the slide connecting member 60 is made of resilient material to provide elasticity thereto. For example and without being limitative, in the embodiment shown, the slide connecting member 60 is a bungee cord having hooks at opposed ends thereof, the bungee cord being connected at a first end to the distal end 40*b* of the slide 40 and at a second opposed end to a section of the handle 30, with the hooks of the bungee cords being inserted in corresponding apertures of the slide 40 and the handle 30. One skilled in the art will understand that, in alternative embodiments (not shown) a slide connecting member 60 different from the bungee cord of the embodiment shown could be used. In an embodiment, the slide connecting member 60 could be made of non-resilient material.

In the pull configuration (FIGS. 3 to 4B), the handle 30 is connected to the upper section 26 of the frame 20 and extends in a direction opposite to the slide extending direction S (i.e. in a direction substantially opposed to the direction in which the slide 40 extends from the frame 20). For example, the apparatus 10 can be configured in the pull configuration, when snow removal from the ground is not appropriate and/or desirable. In such a configuration, the apparatus 10 can be used by a user standing on the snow laden sloped surface, such as at the apex of a roof of a building and pulling the apparatus 10 into the snow accumulated on the roof. Connection of the handle 30 to the upper section 26 of the frame 20, when configured in the pull configuration, is advantageous given that, in such cases, the apparatus 10 is projected by the user over a strip of snow to be removed and subsequently pulled back towards the user through the snow. Therefore, the handle 30 being connected to the upper section 26 of the frame 20 allows the handle 30 to remain over the snow to be removed rather than being required to be pushed through it, which would be undesirable.

In an embodiment, to allow the conversion between the push configuration and the pull configuration, the frame 20 of the snow removal assembly 15 of the apparatus 10 includes handle-engaging apertures 38 defined in each one of the lower section 24 and the upper section 26 of the frame 20. The dual sets of handle-engaging apertures 38 allow the configuration of the apparatus 10 to be easily modified by the user by simply detaching the handle 30 from one section of the frame 20 and attaching the handle 30 to the other section of the frame 20 such that the apparatus can be selectively configured in the push configuration (with the handle 30 connected to the lower section 24 of the frame 20 and extending in a direction similar to the slide 40) or the push configuration (with the handle 30 connected to the lower section 24 of the frame 20 and extending in a direction similar to the slide 40).

In view of the above, the snow removal apparatus 10 advantageously increases the versatility of the apparatus 10 and the ease with which a user can operate the apparatus 10 to carry out snow removal. Whether by performing a pulling motion from the apex of a roof top, or a pushing motion from the ground, a user can easily manipulate the snow removal apparatus 10 to move it upward along the surface of a rooftop, with optimized handle positioning in each configuration. The apparatus 10 thereby minimizes the energy required to effectively remove snow from rooftops, allowing users of broad range of ages and body types to successfully engage in rooftop snow removal.

Now referring to FIGS. 1 to 5A, in the embodiment shown, the frame 20 is coupled generally perpendicularly to the handle 30 by means of a connector (or connecting bracket) 50. As can be seen more clearly in FIGS. 2B and 4B, the connector 50 is attachable between the handle 30 and the frame 20. The connector 50 has a handle-engaging section 52 configured to be removably engageable to the handle 30 and a frame-engaging section 54 removably engageable to the frame 20.

In an embodiment, the connector 50 is made of sturdy and rigid material such as, without being limitative, metal (e.g. aluminum, steel, etc.), hard plastic, carbon fiber or the like. In an embodiment, the connector 50 is a solid component (i.e. a component having the interior completely filled up, free from cavities and without hollow sections) to the exception of apertures for insertion of fasteners, as will be described in more details below. The connector 50 being made of solid material strengthens the apparatus 10 and favors a high rigidity of the frame 20, to provide high durability of the apparatus 10. The connector 50 extends along a longitudinal axis L2.

In an embodiment, the handle-engaging section 52 of the connector 50 is removably engageable to the proximal end 30*a* of the handle 30. For example, in an embodiment, engagement is performed through insertion of the handle-engaging section 52 in a cavity 31 of the handle 30 and using fasteners 32 for securement therebetween. In the embodiment shown, the fasteners 32 are screws extending through apertures defined in the handle 30 and engageable into threaded cavities 34 defined in the handle-engaging section 52 of the connector 50. One skilled in the art will however understand that, in alternative embodiments (not shown), the handle-engaging section 52 of the connector 50 and/or the handle 30 could present different configurations and the handle-engaging section 52 of the connector 50 could be secured to the handle 30 using other alternative means or methods. For example and without being limitative, in an embodiment (not shown), the handle-engaging section 52 of the connector 50 could be superposed to the handle 30 rather than being inserted in a cavity thereof, different fasteners such as, nuts and bolts, rivets or the like could be used, the handle-engaging section 52 of the connector 50 could be secured to the handle 30 through brazing, soldering, or the like, etc. In another alternative embodiment (not shown), the connector 50 could be integral to the handle 30.

In the embodiment shown, the frame-engaging section 54 of the connector 50 includes a substantially flat section 56 superposable to a section of the frame 20. In the embodiment shown, the substantially flat section is substantially parallel to the longitudinal axis L2 of the connector 50. The frame-engaging section 54 engages the frame 20 substantially perpendicularly and allows a strong securement between the connector 50 and the frame 20, thereby preventing long term loosening between the handle 30 and the frame 20. In an embodiment, the frame-engaging section 54 of the connector 50 includes apertures 57 opened in the substantially flat section 56 and extending substantially perpendicular therewith, allowing fasteners 58 such as, for example and without being limitative, screws, nuts and bolts, or the like, to be used to removably secure the frame-engaging section 54 of the connector 50 to the corresponding section of frame 20. For example and without being limitative, in the embodiment shown, the apertures are threaded and securement is performed through insertion of screws 58 in the corresponding apertures 38 defined in the corresponding section of the frame 20 and screwed in the threaded cavities 57 of the connector 50.

Figure 3A:
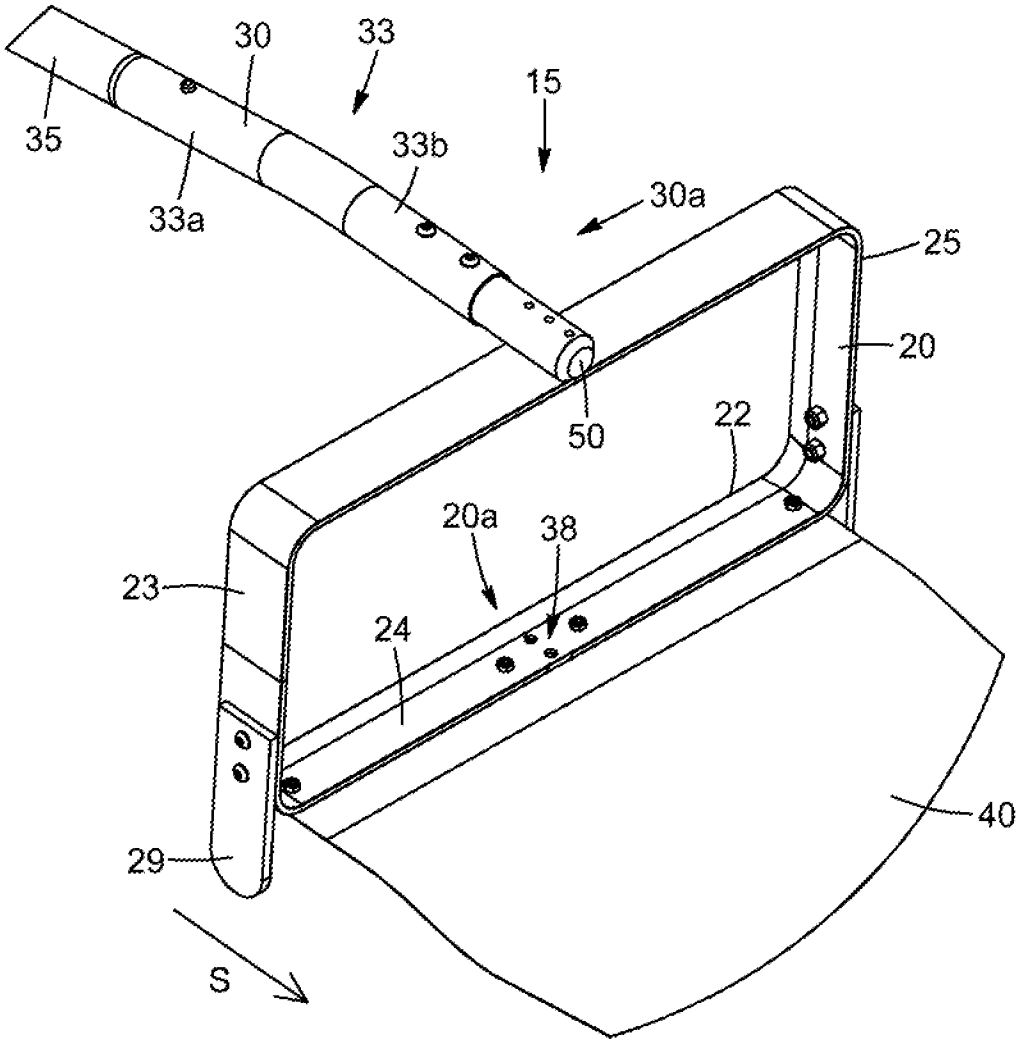
FIG. 3A is an enlarged view of section 3A of the snow removal apparatus of FIG. 3.

In view of the above, in an embodiment, the handle 30 is connected to the lower section 24 of the frame 20 through the connector 50 being secured to the lower section 24 of the frame 20, as described above, to configure the apparatus in the push configuration. Similarly, the handle 30 can be connected to the upper section 26 of the frame 20 through the connector 50 being secured to the upper section 26 of the frame 20, as described above, to configure the apparatus 10 in the pull configuration, in this later case, the connector 50 can therefore be engaged to the upper section 26 of the frame 20 (see FIGS. 3A and 4B), with the handle 30 extending in a direction opposed to the slide 40.

Figure 6:
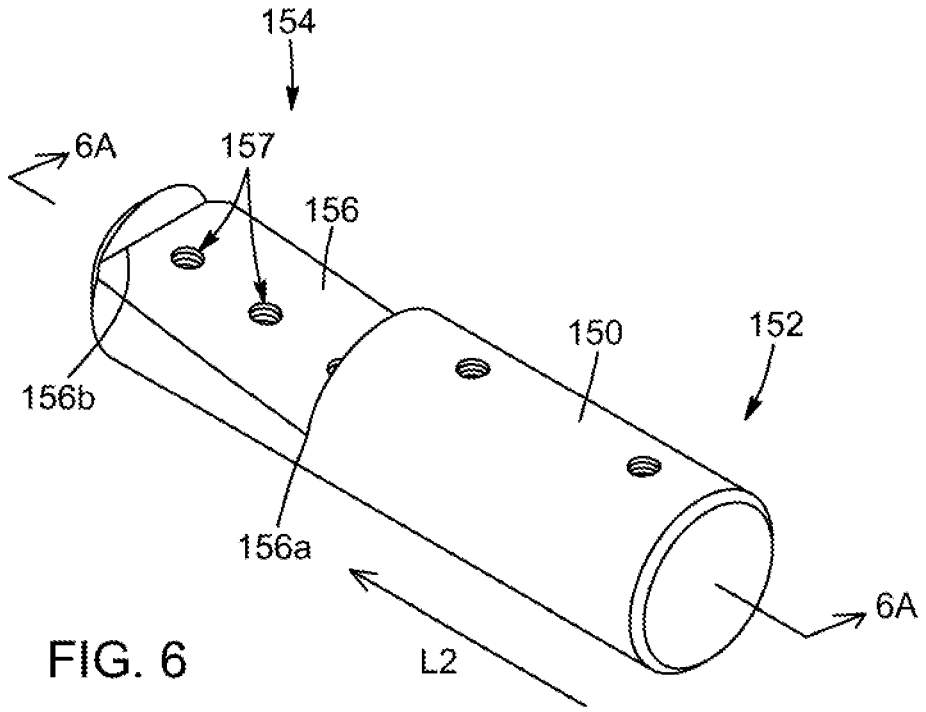
FIG. 6 is a perspective view of a connector of the snow removal apparatus, in accordance with an alternative embodiment.
Figure 6A:
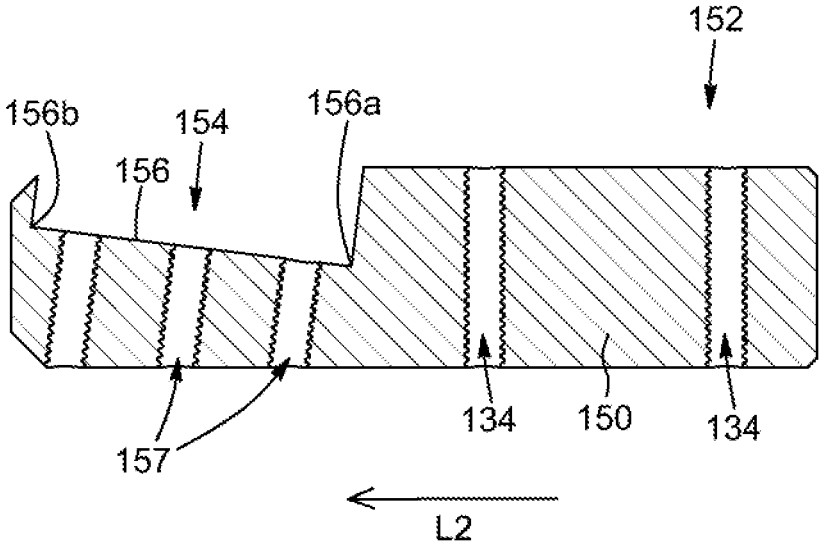
FIG. 6A is a cross sectional view of the connector of FIG. 6, taken along Line 6A-6A in FIG. 6.

Referring to FIGS. 6 and 6A, there is shown an alternative embodiment of the connector 50 wherein the features are numbered with reference numerals in the 100 series, which correspond to the reference numerals of the previous embodiment. In the embodiment shown in FIGS. 6 and 6A, the connector 150 is highly similar to the connector 50 of the previous embodiment, with the exception of the configuration of the substantially flat section 156. Hence, the connector 150 is again a solid component having handle-engaging section 152 configured to be removably engageable to the handle 30 (and having threaded cavities 134 defined therein) and a frame-engaging section 154 removably engageable to the frame 20 (and having apertures 157 opened in the substantially flat section 156 thereof and extending substantially perpendicular with the substantially flat section 156). In the embodiment shown in FIGS. 6 and 6A, the substantially flat section 156 is machined into the body of the connector 50 (i.e. the substantially flat section 156 is spaced apart from the corresponding end of the connector 150 and is defined between two non-flat sections).

In the embodiment shown in FIGS. 6 and 6A, the substantially flat section 156 is also angled relative to the longitudinal axis L2 extending longitudinally of the connector 150. The angle of the substantially flat surface 156 is designed such that, in use, the snow engaging edge 20*a* of the frame 20 has a forward angle (i.e. the plane, along which the snow engaging edge 20*a* extends, is angled relative to the longitudinal axis L1 of the handle 30, with the section of the snow engaging edge 20*a* extending along the upper section 26 extending forwardly of the section of the snow engaging edge 20*a* of the of the lower section 24) and therefore engages the snow more aggressively. Hence, the connector 150 is designed to be used in combination with a substantially straight handle 30 (i.e. a handle 30 without the above-described angled section 33 and extending substantially along the Longitudinal axis L1 thereof along its entire length) to provide the desired angle for the snow engaging edge 20*a* of the frame 20.

In the embodiment shown, the connector 150 is configured to be mounted to the frame 20, with the substantially flat section 156 facing downwardly. Hence, in such an embodiment, the substantially flat surface 156 has an inner end 156*a* and an outer end 156*b*, with the inner end 156*a* being recessed in the connector 150 of a distance greater than the outer end 156*b*. One skilled in the art will understand that, in an alternative embodiment (not shown), only the inner end 156*a* of the substantially flat surface 156 could be recessed in the connector 150 to provide the angle of the substantially flat section 156.

In an embodiment, the substantially flat section 156 is angled of between about 7° and about 14° with respect to the longitudinal axis L2 of the connector 150. More precisely, in an alternative embodiment, the substantially flat section 156 is angled of between about 7° and about 10° with respect to the longitudinal axis L2 of the connector 150. Even more precisely, in the embodiment shown, the substantially flat section 156 is angled of about 8° with respect to the longitudinal axis L2 of the connector 150.

One skilled in the art will also understand that, in an alternative embodiment (not shown) the substantially flat surface 156 could be angled of a smaller angle, with the handle 30 including an angled section 33 also having a smaller angle, such that the resulting angle provided by the combination of the angled substantially flat surface 156 of the connector 150 and the angled section 33 of the handle 30 is substantially similar to the above mentioned angular ranges of the substantially flat surface 156 of the connector 150 or the angled section 33 of the handle 30. In another alternative embodiment, the lower section 24 and/or the upper section 26 of the frame 20 could have an angle relative to the longitudinal angle L2 of the connector 150, in order to provide the desired forward angle of the snow engaging edge 20*a* of the frame 20. In another alternative embodiment (not shown), the connector 150 could have a first substantially straight section (not shown) and a second substantially straight section (not shown) angled relative to one another, rather than an angled substantially flat surface 156 to provide the desired angle to the snow engaging edge 20*a* of the frame 20.

One skilled in the art will understand that, in alternative embodiments (not shown), the frame-engaging section 54, 154 of the connector 50, 150 and/or the corresponding section of the frame 20 could present different configurations and the frame-engaging section 54, 154 of the connector 50, 150 could be removably secured to the corresponding section of the frame 20 using other alternative means or methods. For example and without being limitative, in an embodiment (not shown), the frame-engaging section 54, 154 of the connector 50, 150 or the corresponding section of the frame 20 could include unthreaded cavities for insertion of bolts therein and in the corresponding handle-engaging apertures 38 defined in the frame 20 and secured using bolts, or different male/female assembly for locking/unlocking the components could be used.

Moreover, in other alternative embodiments (not shown), the connector 50, 150 can be shaped differently to offer a different configuration of the substantially flat section 56, 156. For example, and without being limitative, a slot can be defined into the body of the connector 50, 150 for at least partially receiving therein the corresponding section of the frame 20. In view of the above, it will be understood that the slot could be substantially parallel to the longitudinal axis L2 of the connector 50, 150 or be angled relative to the longitudinal axis L2 of the connector 50, 150.

One skilled in the art will also understand that, in alternative embodiments (not shown) handle connecting assemblies different than the handle-engaging apertures 38 defined in the frame 20 of the snow removal assembly 15 could be provided.

Figure 7:
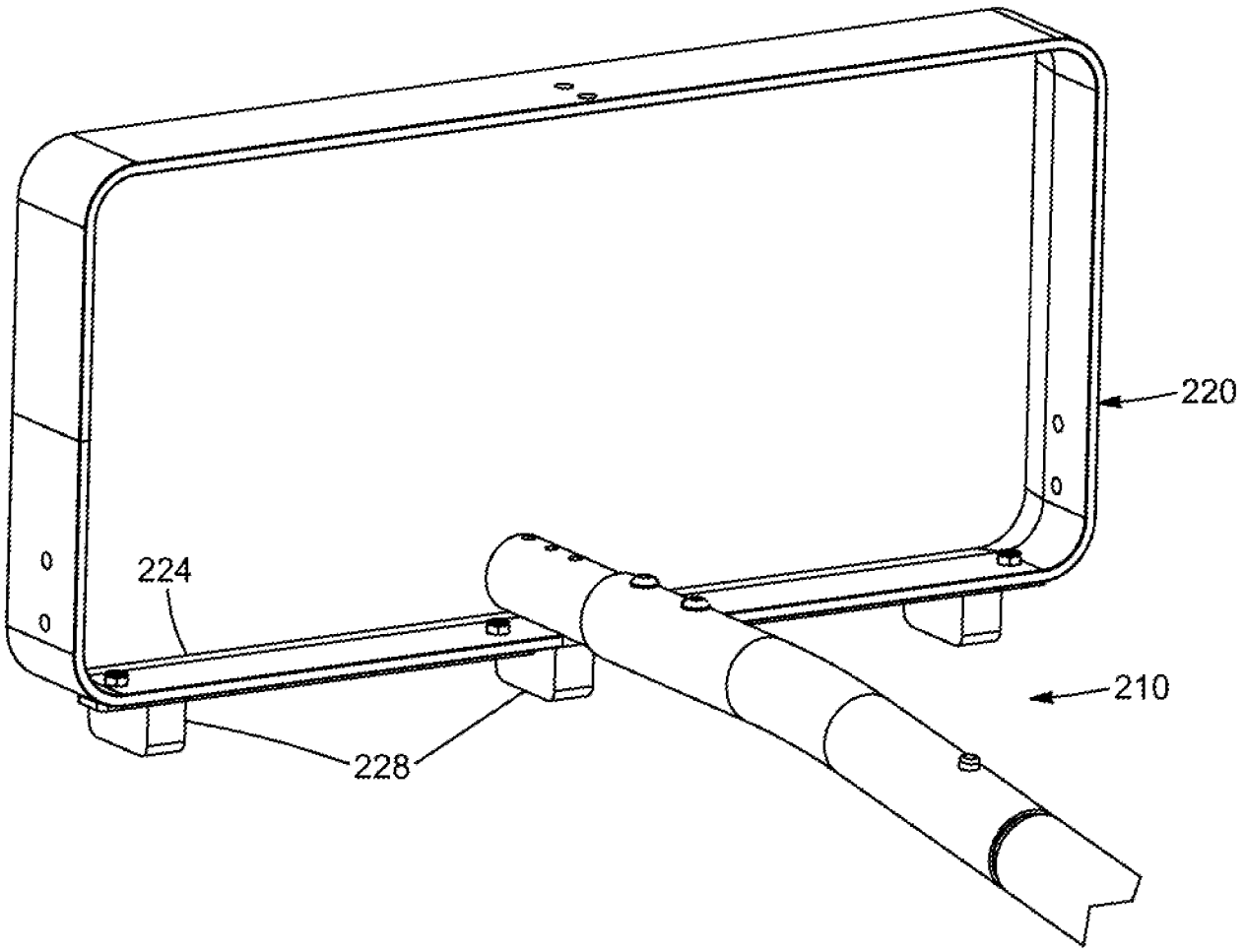
FIG. 7 is a perspective view of a snow removal apparatus, in accordance with an alternative embodiment where the frame includes skids extending from the bottom section thereof, the snow removal apparatus being shown without the slide.

Now referring to FIG. 7, there is shown an alternative embodiment of the apparatus wherein the features are numbered with reference numerals in the 200 series which correspond to the reference numerals of the previous embodiment. In the embodiment of FIG. 7, the apparatus 210 includes skids 228 extending downwardly from the lower section 224 of the frame 220 rather than the above described extension members 29. The skids 228 allow the snow removal apparatus 210 to slide on the sloped surface during use, thereby preventing potential damaging of the roof covering or other material covering the sloped surface. In an embodiment, the skids 228 can be integral to the frame 220, and more precisely, integral to the lower section 224 of the frame 220. In an alternative embodiment, the skids 228 can also be mounted to the frame 220, for example using fasteners such as, without being limitative, screws, nuts and bolts, rivets, or the like, be secured to the frame 220 by soldering or brazing, etc.

One skilled in the art will understand that, in alternative embodiments (not shown), other motion facilitating members designed to allow the apparatus to move onto the sloped surface without damaging the surface it is moved over, can be used. For example, in an embodiment (not shown), wheels (not shown) could be mounted to the extension members 29 of the embodiment shown in FIGS. 1 to 4B and which extend from the connecting sections 23, 25 of the frame 20. In another alternative embodiment (not shown) adjustable skids could be used.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A snow removal apparatus for cutting and removing snow from a sloped surface, the apparatus comprising:

a frame having a lower section and an upper section spaced apart from one another, the lower section and the upper section having a width and being connected by side sections;

an elongated handle removably engageable to the frame;

a connector connecting the elongated handle to the frame, the connector extending along a longitudinal axis thereof and including a frame-engaging section having a recessed substantially flat section superposable to the corresponding one of the lower section and the upper section of the frame and securable thereto, the recessed substantially flat section having a length substantially similar to the width of the lower section and the upper section of the frame, in order to allow the connector to be mounted directly to the corresponding one of the lower section and the upper section of the frame with the flat section being superposed to the corresponding one of the lower section and the upper section along the entire width thereof; and a slide having a proximal end operatively connected to the lower section of the frame and a distal end, the slide extending away from the frame in a slide extending direction;

wherein the apparatus is selectively configurable in a push configuration where the handle is engaged to the lower section of the frame and extends in a direction substantially similar to the slide extending direction and a pull configuration where the handle is engaged to the upper section of the frame and extends in a direction substantially opposite to the slide extending direction.

2. The snow removal apparatus of claim 1, wherein each one of the lower section and the upper section of the frame comprises handle securement apertures defined therein, the handle securement apertures being configured to receive fasteners to selectively secure the connector to the corresponding one of the lower section and the upper section of the frame.

3. The snow removal apparatus of claim 1, wherein the substantially flat section is angled relative to the longitudinal axis of the connector.

4. The snow removal apparatus of claim 3, wherein the substantially flat section is angled of between about 7° and about 14° relative to the longitudinal axis of the connector.

5. The snow removal apparatus of claim 1, wherein the elongated handle includes an angled section having a first substantially straight section and a second substantially straight section extending at an angle relative to one another.

6. The snow removal apparatus of claim 5, wherein the angled section defines an angle of between about 7° and about 14° between the first substantially straight section and the second substantially straight section.

7. The snow removal apparatus of claim 1, further comprising a slide connecting member having a first end and a second end, the first end of the slide connecting member being connectable to the slide, at the distal end thereof, and the second end of the slide connecting member being connectable to a section of the elongated handle, when the apparatus is configured in the push configuration.

8. The snow removal apparatus of claim 1, wherein the frame has a snow engaging edge facing in a direction opposite to the slide extending direction, the snow engaging edge having a tapered configuration to define a tapered cutting edge.

9. The snow removal apparatus of claim 1, further comprising extension members projecting downwardly from the lower section of the frame, at opposed ends thereof.

10. A snow removal apparatus for cutting and removing strips of snow from a sloped surface, the apparatus comprising:

a snow removal assembly including a frame having a lower section and an upper section, the lower section and the upper section of the frame being substantially parallel to one another, with the upper section extending above the lower section;

a slide operatively engaged to the lower section of the frame and extending away therefrom;

an elongated handle selectively securable to one of the lower section and the upper section of the frame, the handle being secured to the lower section of the frame to configure the apparatus in a push configuration and being secured to the upper section of the frame to configure the apparatus in a pull configuration; and a connector connecting the elongated handle to the frame, the connector extending along a longitudinal axis thereof and including a frame-engaging section having a recessed substantially flat section directly superposable to the corresponding one of the lower section and the upper section of the frame along an entire width thereof and securable thereto.

11. The snow removal apparatus of claim 10, wherein the slide extends in a slide extending direction and wherein the elongated handle extends in a direction substantially similar to the slide extending direction when the apparatus is configured in the push configuration and in a direction substantially opposite to the slide extending direction when the apparatus is configured in the pull configuration.

12. The snow removal apparatus of claim 10, wherein each one of the lower section and the upper section of the frame comprises handle securement apertures defined therein, the handle securement apertures being configured to receive fasteners to selectively secure the handle connector to the corresponding one of the lower section and the upper section of the frame.

13. The snow removal apparatus of claim 10, wherein the substantially flat section is angled relative to the longitudinal axis of the connector.

14. The snow removal apparatus of claim 13, wherein the substantially flat section is angled of between about 7° and about 14° relative to the longitudinal axis of the connector.

15. The snow removal apparatus of claim 10, wherein the elongated handle includes an angled section having a first substantially straight section and a second substantially straight section extending at an angle relative to one another.

16. The snow removal apparatus of claim 15, wherein the angled section defines an angle of between about 7° and about 14° between the first substantially straight section and the second substantially straight section.

17. The snow removal apparatus of claim 10, wherein the slide has a distal end, the apparatus further comprising a slide connecting member having a first end and a second end, the first end of the slide connecting member being connectable to the slide, at the distal end thereof, and the second end of the slide connecting member being connectable to a section of the elongated handle, when the apparatus is configured in the push configuration.

18. The snow removal apparatus of claim 10, wherein the frame has a snow engaging edge facing in a direction opposite to the slide extending direction, the snow engaging edge having a tapered configuration to define a tapered cutting edge.

19. The snow removal apparatus of claim 10, further comprising extension members projecting downwardly from the lower section of the frame, at opposed ends thereof.

* * * * *